US008807789B2

(12) United States Patent
Peck

(10) Patent No.: US 8,807,789 B2
(45) Date of Patent: Aug. 19, 2014

(54) LED ILLUMINATION DEVICE FOR PROJECTING LIGHT DOWNWARD AND TO THE SIDE

(75) Inventor: John P. Peck, Manasquan, NJ (US)

(73) Assignee: Dialight Corporation, Farmingdale, NJ (US)

( * ) Notice: Subject to any disclaimer, the term of this patent is extended or adjusted under 35 U.S.C. 154(b) by 1153 days.

(21) Appl. No.: 12/580,840

(22) Filed: Oct. 16, 2009

(65) Prior Publication Data

US 2011/0090685 A1 Apr. 21, 2011

(51) Int. Cl.
*F21V 7/00* (2006.01)
*F21V 7/04* (2006.01)

(52) U.S. Cl.
CPC ..... *F21V 7/04* (2013.01)
USPC ..... 362/235

(58) Field of Classification Search
None
See application file for complete search history.

(56) References Cited

U.S. PATENT DOCUMENTS

| | | | |
|---|---|---|---|
| 4,268,799 | A | 5/1981 | McCrickerd |
| 4,818,875 | A | 4/1989 | Weiner |
| 4,929,866 | A | 5/1990 | Murata et al. |
| 5,136,483 | A | 8/1992 | Schoniger et al. |
| 5,272,570 | A | 12/1993 | Yoshida et al. |
| 5,642,933 | A | 7/1997 | Hitora |
| 5,769,532 | A | 6/1998 | Sasaki |
| 5,800,051 | A | 9/1998 | Gampe et al. |
| 5,929,788 | A | 7/1999 | Vukosic |
| 6,183,100 | B1 | 2/2001 | Suckow et al. |
| 6,464,373 | B1 | 10/2002 | Petrick |
| 6,637,921 | B2 | 10/2003 | Coushaine |
| 6,717,526 | B2 | 4/2004 | Martineau et al. |
| 6,948,836 | B2 | 9/2005 | Ishida et al. |
| 7,070,301 | B2 | 7/2006 | Magarill |
| 7,078,700 | B2 | 7/2006 | Chandhok et al. |
| 7,160,004 | B2 | 1/2007 | Peck |
| 7,568,821 | B2 | 8/2009 | Peck et al. |
| 7,604,384 | B2 | 10/2009 | Peck |
| 7,611,264 | B1 | 11/2009 | Chang |
| 7,648,258 | B2 | 1/2010 | Shuai et al. |
| 7,658,513 | B2 | 2/2010 | Peck |
| 8,240,885 | B2 | 8/2012 | Miller |
| 2002/0105807 | A1 | 8/2002 | Loughrey |
| 2003/0169599 | A1* | 9/2003 | Natsume ..... 362/543 |
| 2003/0193807 | A1 | 10/2003 | Rizkin et al. |
| 2004/0042212 | A1 | 3/2004 | Du et al. |

(Continued)

FOREIGN PATENT DOCUMENTS

| | | |
|---|---|---|
| CN | 201069136 Y | 6/2008 |
| CN | 201 133 628 | 10/2008 |

(Continued)

OTHER PUBLICATIONS

Ensa, "100W LED Flood Light," Sep. 1, 2007.

(Continued)

*Primary Examiner* — Britt D Hanley

(57) ABSTRACT

An LED (light emitting diode) illumination device that can generate a uniform light output illumination pattern. The illumination device includes an array of LEDs, each having a LED central axis. The LED central axis of the array of LEDs is angled approximately toward a central point. The illumination source includes a reflector with a conic or conic-like shape. The reflector wraps around the front of the LED to redirect the light emitted along a LED central axis.

13 Claims, 13 Drawing Sheets

(56) References Cited

U.S. PATENT DOCUMENTS

| | | | |
|---|---|---|---|
| 2004/0057234 | A1 | 3/2004 | Mohacsi et al. |
| 2004/0062044 | A1 | 4/2004 | Hanano |
| 2005/0231916 | A1 | 10/2005 | Bahl et al. |
| 2005/0276061 | A1 | 12/2005 | Repetto et al. |
| 2006/0012990 | A1 | 1/2006 | Walser et al. |
| 2006/0171801 | A1 | 8/2006 | Manabe et al. |
| 2006/0176702 | A1 | 8/2006 | Shen et al. |
| 2006/0262551 | A1 | 11/2006 | Fallahi et al. |
| 2006/0291209 | A1 | 12/2006 | Booth et al. |
| 2007/0133213 | A1 | 6/2007 | Peck |
| 2007/0253202 | A1 | 11/2007 | Wu et al. |
| 2007/0279862 | A1 | 12/2007 | Li |
| 2008/0247170 | A1 | 10/2008 | Peck |
| 2008/0253127 | A1 | 10/2008 | Willwohl et al. |
| 2008/0266866 | A1 | 10/2008 | Tsai |
| 2008/0285271 | A1 | 11/2008 | Roberge et al. |
| 2009/0002985 | A1 | 1/2009 | Peck et al. |
| 2009/0103308 | A1 | 4/2009 | Xu et al. |
| 2009/0129102 | A1 | 5/2009 | Xiao |
| 2009/0161352 | A1 | 6/2009 | Mackin et al. |
| 2011/0280019 | A1 | 11/2011 | Zimmer et al. |
| 2012/0262919 | A1 | 10/2012 | Peck et al. |
| 2013/0155687 | A1 | 6/2013 | Zimmer et al. |

FOREIGN PATENT DOCUMENTS

| | | |
|---|---|---|
| DE | 10 2004 001 052 | 11/2004 |
| EP | 1 357 332 | 10/2003 |
| EP | 1 411 291 | 4/2004 |
| JP | A-9-330604 | 5/1997 |
| JP | 2004341067 | 12/2004 |
| JP | 2008-159380 | 10/2008 |
| JP | 2009-026481 | 5/2009 |
| JP | 2009-117328 | 5/2009 |
| WO | WO 01/86198 | 11/2001 |
| WO | WO 2008/137824 A1 | 11/2008 |
| WO | WO 2008/140884 A1 | 11/2008 |
| WO | WO 2010/035996 | 4/2010 |

OTHER PUBLICATIONS

PCT Communication: Third Party Observation for International Application No. PCT/US2011/029889, mailed Aug. 27, 2013, consists of 5 unnumbered pages.

PCT Search Report and Written Opinion for PCT/US07/68967, Sep. 15, 2008, copy consists of 13 pages.

Extended European Search Report for Application No. EP06110676, Jun. 20, 2007, copy consists of 11 unnumbered pages.

Partial European Search Report for EP Application EP 06110676, copy consists of 4 unnumbered pages.

International Search Report and Written Opinion issued on May 31, 2011 in corresponding International Application No. PCT/US11/29889 filed on Mar. 25, 2011.

Supplementary European Search Report for International Patent Application Serial No. PCT/US2011/029889, dated Nov. 27, 2013, consists of 8 pages.

Japanese Office Action from JP2012-534189, dated Jun. 3, 2014. (English translation attached). pp. 1-6.

* cited by examiner

LED ILLUMINATION DEVICE FOR PROJECTING LIGHT DOWNWARD AND TO THE SIDE

CROSS-REFERENCE TO RELATED APPLICATIONS

The present patent document is related to U.S. application Ser. No. 11/620,968 filed on Jan. 8, 2007, which is a continuation-in-part of U.S. application Ser. No. 11/069,989 filed Mar. 3, 2005, the entire contents of each of which are hereby incorporated herein by reference.

BACKGROUND OF THE INVENTION

1. Field of the Invention

The present invention is directed to an LED (light emitting diode) and reflector illumination device that creates a highly uniform illumination/intensity pattern.

2. Description of the Related Art

In many applications it is desirable to create a uniform illumination pattern used for general illumination applications such as high-bay, low-bay, parking area, warehouses, street lighting, parking garage lighting, and walkway lighting. In these applications the light fixture must direct the majority of the light outward at high angles and have only a small percentage of the light directed downward.

Generally, light sources emit light in a spherical pattern. Light emitting diodes (LEDs) are unique in that they emit light into a hemispherical pattern from about −90° to 90° as shown in FIG. 10A. Therefore, to utilize an LED as a light source in a conventional manner reflectors are placed around an LED.

When a light source illuminates a planar target surface area directly in front of it, as is the case when the LED optical axis is aligned to the light fixture optical axis, the illuminance in footcandles (fc) decreases as a function of the $\cos^3 \theta$. This is known as the $\cos^3 \theta$ effect. The LED distribution shown in FIG. 10A approximately follows a $\cos \theta$ distribution. A $\cos^4 \theta$ illumination profile results when a light source with a $\cos \theta$ intensity distribution illuminates a surface due to the combination of the $\cos \theta$ and the $\cos^3 \theta$ effect. The $\cos^4 \theta$ illumination distribution would result in front of the LED if no optic is used with a typical LED source. FIG. 10B illustrates this by showing the high illuminance level at a value of 0 for the ratio of distance to mounting height (directly below the fixture) for the background LED illumination device with no optic. The illuminance values drop off rapidly and reach almost 0 at a value of 2.5 for the ratio of distance to mounting height.

FIG. 11 shows a background LED illumination device 10 including an LED 1 and a reflector 11. The reflector 11 can revolve around the LED 1. In the background LED illumination device in FIG. 11 the LED 1 and reflector 11 are oriented along the same axis 12, i.e. along a central optical axis 12 of the reflector 11, and the LED 1 points directly out of the reflector 11 along the axis 12.

With the LED illumination device 10 in FIG. 11, wide-angle light is redirected off of the reflector 11 and narrow angle light directly escapes. The result is that the output of the LED illumination device 10 is a narrower and more collimated beam of light. Thereby, with such an LED illumination device 10, a circular-based illumination pattern is created. Since most LEDs have a Cosine-like intensity pattern as shown in FIG. 10*a*, this results in a hot spot directly in front of the LEDs when illuminating a target surface. The reflector 11 can increase the illuminance at various areas of the target surface but the reflector 11 cannot reduce the hot spot directly in front of the LED 1.

Therefore, orienting the LED 1 and the reflector 11 along the same axis 12 as in FIG. 11 while pointing the LED 1 directly toward a target area, such as downward toward the ground, results in a hot spot directly in front of the light fixture.

SUMMARY OF THE INVENTION

The present inventor recognized that certain applications require highly uniform illumination patterns. In some cases a hot spot would be undesirable and the illumination must not exceed a ratio of 10 to 1 between the highest and lowest illuminance values within the lighted target area.

In aspects of the present invention herein, the LED central axis may be positioned away from the target area to avoid creating a hot spot directly in front of the light fixture. A reflector may be used and a reflector portion may reflect light and direct only an appropriate amount of light directly in front of the fixture. As a result the hot spot can be reduced or eliminated.

The present invention achieves the desired results of generating a highly uniform illumination pattern by providing a novel illumination source including one or more LEDs and one or more reflectors. The one or more LEDs and one or more reflectors can be referred to as an illumination source. The one or more reflectors may have one or more segments. The reflector segments may be flat or may have curvature. The reflector segments may have concave or convex curvatures in relation to the LED. The curvatures of the reflector segments may have conic or conic-like shapes or cross sections. The reflector surfaces may be designed and positioned so that light from the LED central axis of the LED is diverted away from the LED central axis. The reflector may be designed and positioned so that light emitted from the LED at various positive angles is redirected to specific negative angles. The reflector may be designed and positioned so that light emitted from the LED at various negative angles is redirected to different specific negative angles. The reflector may be designed and positioned so that light emitted from the LED at various angles is significantly changed so that the light is essentially folded back. The reflector may be designed and positioned so that light emitted from the LED at various negative angles is not redirected.

A further goal of the present invention is to realize a small and compact optical design.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
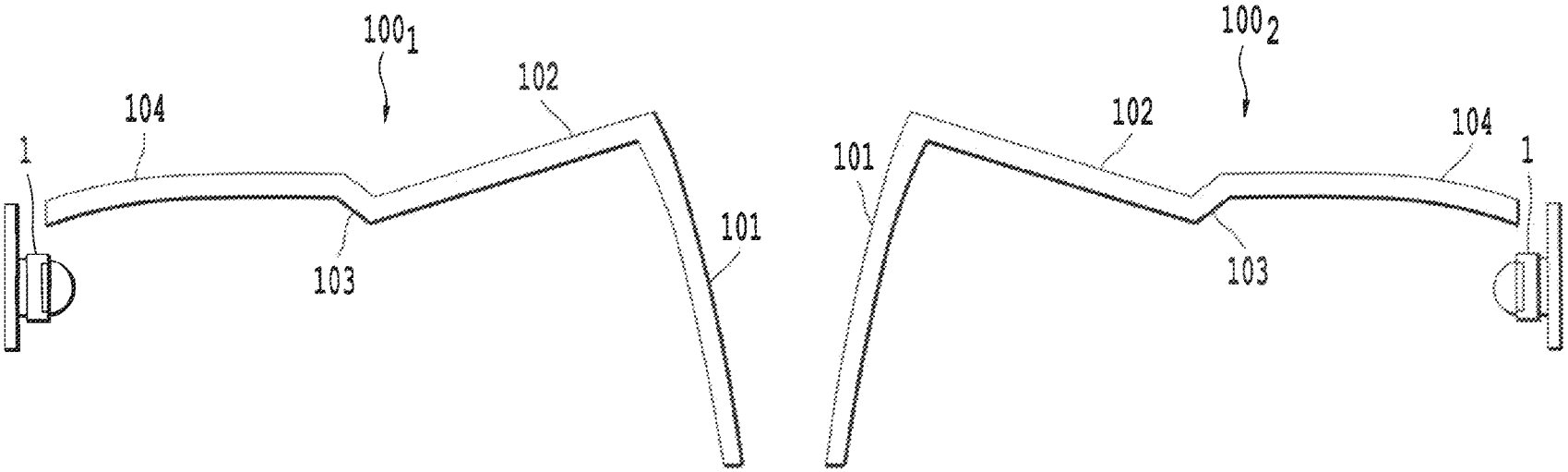
FIG. 1 shows an embodiment of an illumination device in the present invention.

Referring now to the drawings, wherein like reference numerals designate identical or corresponding parts throughout the several views, and more particularly to FIGS. 1, 2, 3A-3E, and 4A-4E thereof, embodiments of LED illumination devices 100 and 110 of the present invention are shown.

Figure 2:
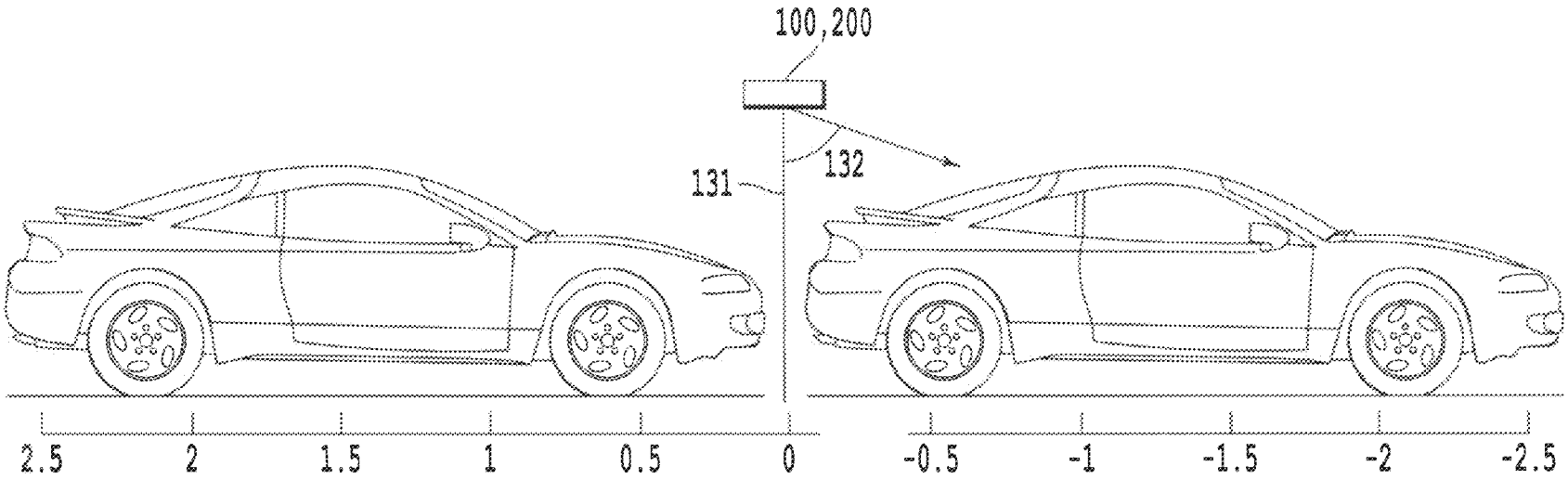
FIG. 2 shows an implementation of the illumination devices in the present invention.

First, applicants note FIG. 1 discloses an embodiment of an LED illumination device including two separate illumination device elements $\mathbf{100}_1$ and $\mathbf{100}_2$. That embodiment is discussed in further detail below. FIG. 2 shows how such an illumination device can be implemented as a parking bay lighting in which light is desired to be projected downward and to the side, also discussed further below.

The embodiments noted in FIGS. 3A-3E and 4A-4E show utilization of a single LED illumination device 100 and 200, rather than the two illumination devices $\mathbf{100}_1$ and $\mathbf{100}_2$ as shown in FIG. 1. Those embodiments are now discussed in further detail.

As shown in FIGS. 3A-3E, an LED illumination device 100 of the present invention includes the LED light source 1 and a reflector 15 with different reflector segments 101, 102, 103, 104. As shown in FIGS. 4A-4E, an LED illumination device 200 of the present invention includes the LED light source 1 and a reflector 25 with different reflector segments 111, 112, 113, 114.

Figure 3A:
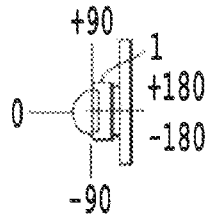
FIGS. 3A-3E show an embodiment of an illumination device of the present invention.
Figure 3B:
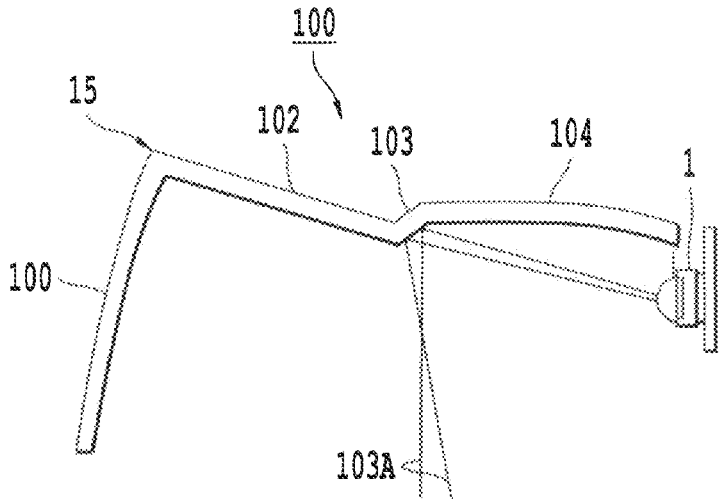
Figure 3C:
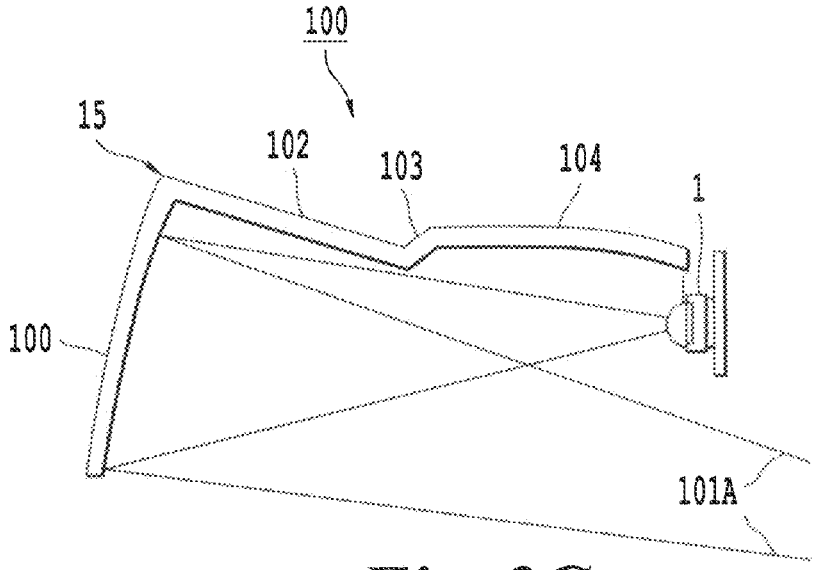
Figure 3D:
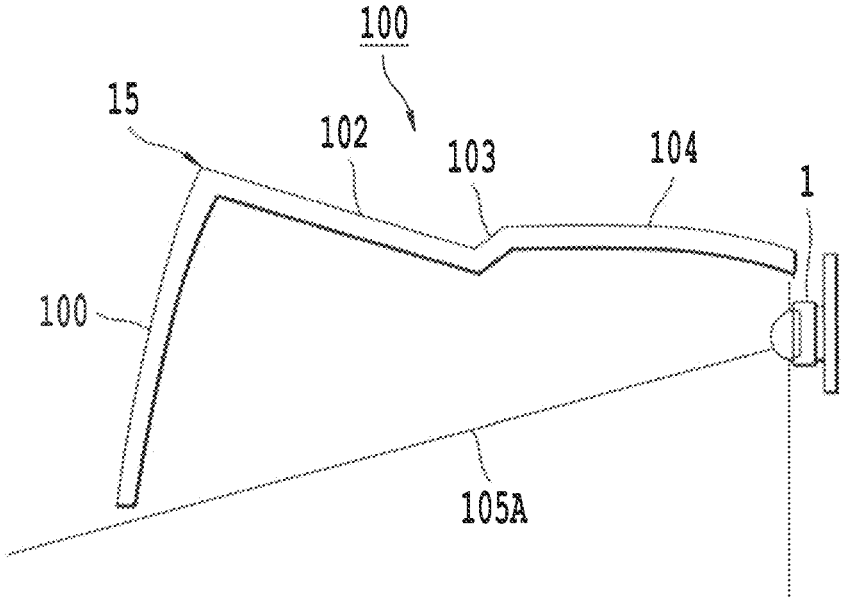
Figure 3E:
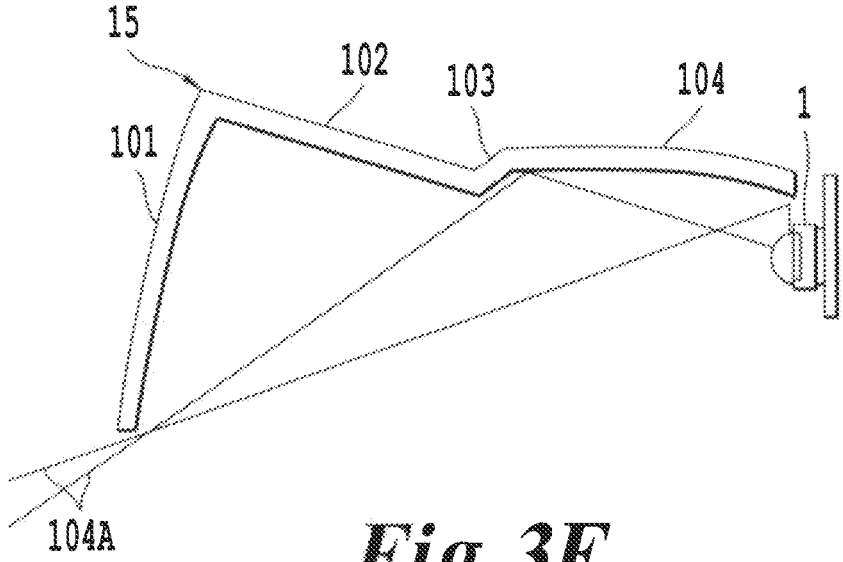
Figure 4A:
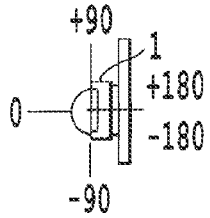
FIGS. 4A-4E show another embodiment of an illumination device of the present invention.

In the embodiments of the present invention shown in FIGS. 3A-3E and 4A-4E, one or more LEDs 1 (only a single LED 1 being shown in FIGS. 3A-3E and 4A-4E) are positioned at about 90° with respect to the general light distribution. The general light distribution corresponds to −90 in FIGS. 3A-3E and 4A-4E. The general light distribution may also be the fixture optical axis 131 shown in FIG. 2. FIGS. 3A and 4A show the LED 1 along a central axis at 0° to ±180°. As an example, the LED 1 may be positioned horizontally with respect to the ground, or target area; horizontal is for reference purposes only as the light fixture may be mounted in any orientation. For example the fixture could be aimed downward at the ground, sideways at a wall, up at the ceiling, at other angles, etc.

The LED illumination devices 100 and 200 of FIGS. 3A-3E and 4A-4E, in the configuration and orientation shown, can be inserted into and used in the light fixture 100, 200 shown in FIG. 2. FIG. 2 shows an example in which the LED illumination device 100, 200 can be used as a parking bay light in which light is desired to be projected downward to the ground and sideways, but not upward.

Positioning the one or more LEDs horizontally directs the peak intensity sideways and not downward. The intensity peak at 0° shown in FIG. 10A would be directed horizontally and, without an optic, there would be almost no light directed downward since "downward" would correspond to −90° in FIG. 10A.

As shown in FIG. 3B, a portion or a segment 103 of the reflector 15 can be used to direct a smaller and more appropriate amount of light downward so that there is only an appropriate illuminance level directly below the fixture. As shown in FIG. 4C, a portion or segment 111 of the reflector 25 can be used to direct a smaller and more appropriate amount of light downward so that there is only an appropriate illumination level directly below the fixture.

In many applications such as that shown in FIG. 2, light is only desired up to an angle of about 70° with respect to the light fixture optical axis 131 of FIG. 2. In applications such as street lighting, light at angles greater than 70° with respect to the light fixture optical axis 131 may be considered glare and be undesirable. However, to illuminate out to 2.5 ratio of distance to mounting height, very high intensity light is required at angles around +/−70° to illuminate the outer points of the target area. The "outer points" may, for example, correspond to values of +/−2.5 ratio of distance to mounting height in the figures shown here. FIG. 2 shows an example application in a parking bay lighting in which a light ray that would be incident on a 2.5 ratio of distance to mounting height value would exit the light fixture at an angle 132 of about 70°. Sufficiently high light intensity at up to 70° can be realized with the present invention. This may be accomplished by using a reflector structure to reflect LED light emitted at certain angles toward other specific high angles while allowing LED light emitted at other angles to escape below the reflector at high angles.

The embodiments of FIGS. 3A-3E and 4A-4E provide a structure to realize the above-noted desired illumination properties beneficial in an illumination device such as shown in FIG. 2.

The reflector 15 in the embodiment of the illumination device of FIGS. 3A-3E may be designed to reflect light 101A back at angles between −130° and −160° with respect to the LED central axis as shown in FIG. 3C. In one embodiment at least a portion of the light emitted from the LED between +10° and −10° is reflected back at angles between −130° and −160° with respect to the LED central axis.

Figure 4B:
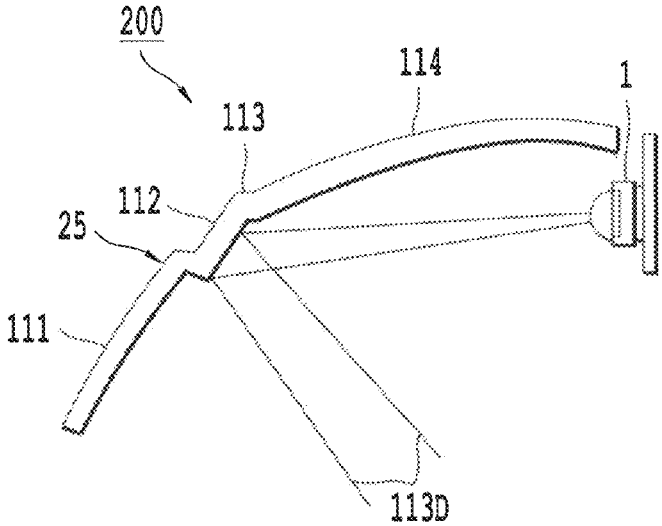
Figure 4C:
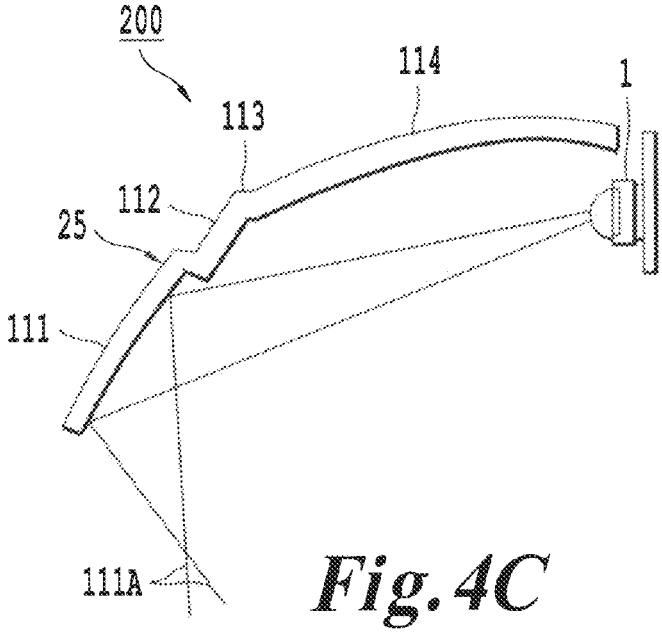
Figure 4D:
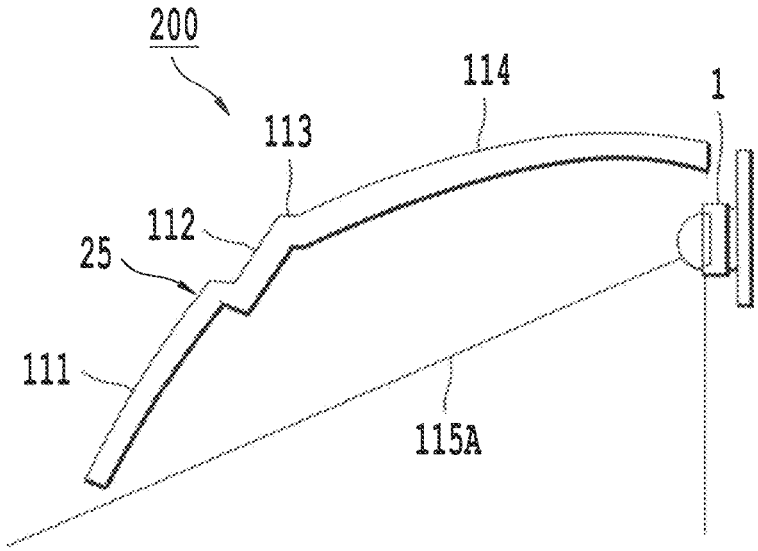

In the further embodiment of the illumination device of FIGS. 4A-4E, and as shown in FIG. 4B, the reflector 25 may be designed to reflect light 111A back at angles between −100° and −130° with respect to the LED central axis. In that embodiment at least a portion of the light emitted from the LED between −10° and −40° is reflected back at angles between −100° and −130° with respect to the LED central axis. In one embodiment, the reflector 25 may reflect light back at angles more negative than −100° with respect to the LED central axis. In one embodiment at least a portion of the light emitted from the LED between −10° and −40° is reflected back at angles between −100° and −180° with respect to the LED central axis.

To further increase the light intensity at high angles, the reflectors 15, 25 may redirect a portion of the light emitted by the LED 1 between specific positive angles. This may be achieved with a reflectors 15 and 25 that has apex section 104 or 114 with a curve downward toward the LED 1.

Figure 4E:
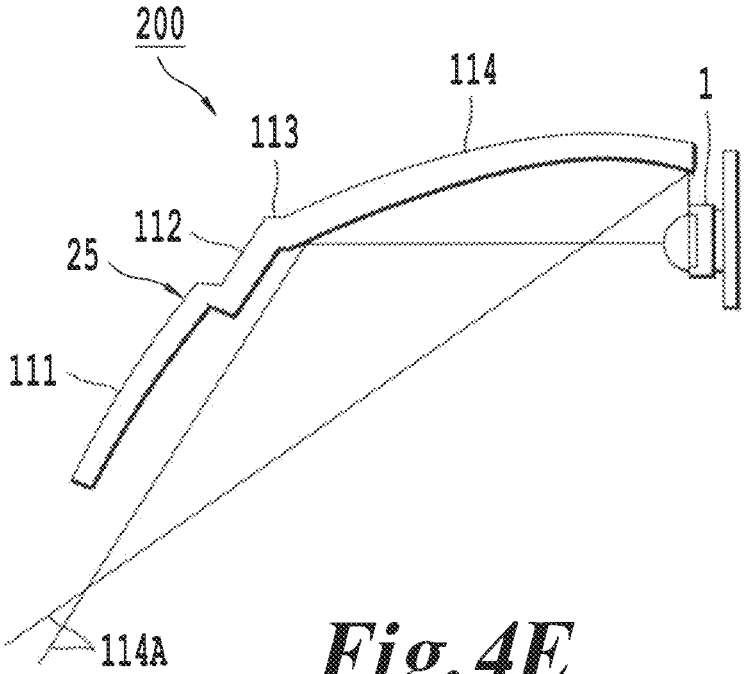

The reflectors 15 and 25 may further be designed to reflect positive angle light from the LED 1 to negative angles with respect to the LED central axis as shown in FIG. 3E and FIG. 4E.

FIG. 3E shows an exemplary embodiment wherein the reflector 15 may be designed to reflect positive angle light from the LED to angles 104A between −30° and −50° with respect to the LED central axis. In that embodiment at least a portion of the light emitted from the LED between +0° and +60° is reflected to angles between −30° and −50° with respect to the LED central axis. In a further embodiment, the reflector may reflect light to angles between −30° and −90° with respect to the LED central axis. In one embodiment at least a portion of the light emitted from the LED between +0° and +60° is reflected at angles between −30° and −90° with respect to the LED central axis.

Figure 5:
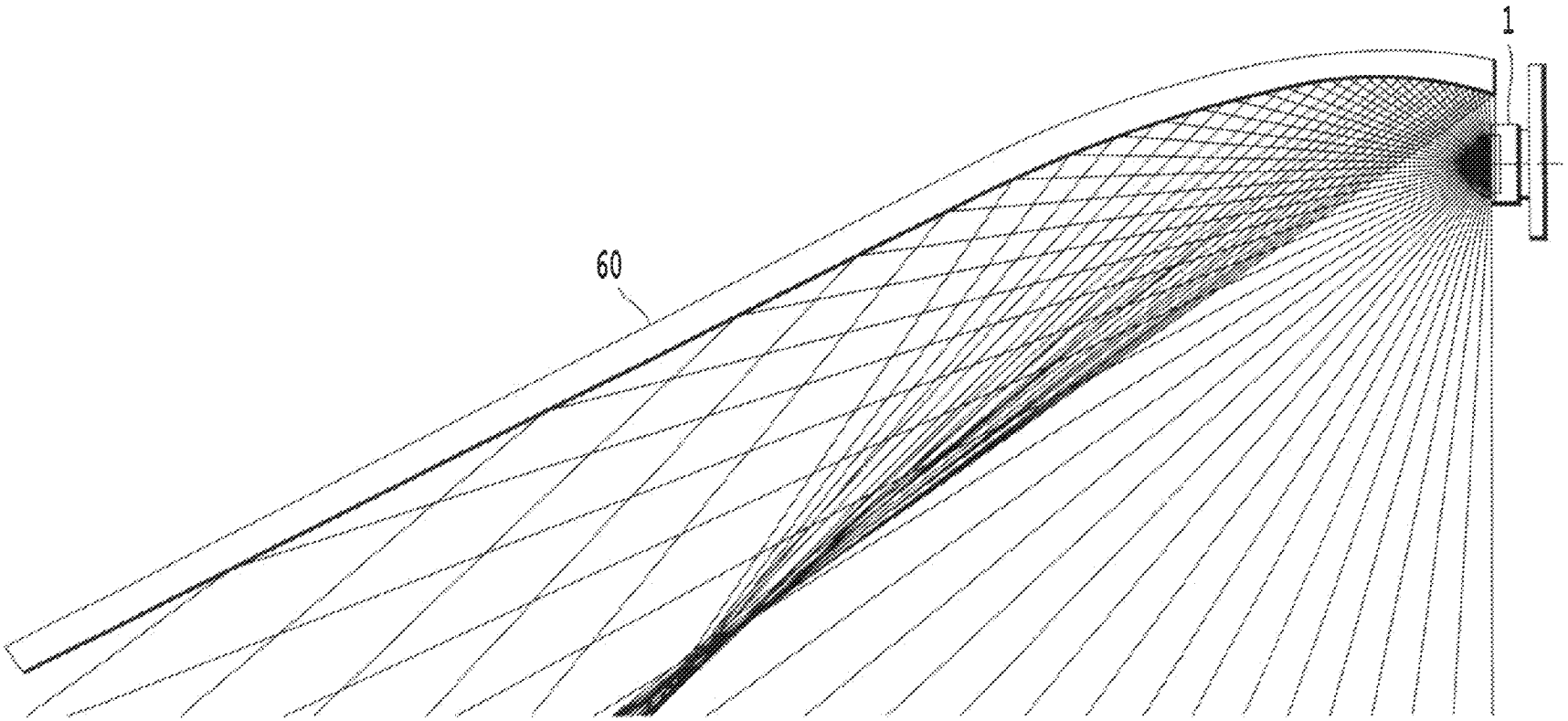
FIG. 5 shows ray tracing of a comparative reflector.

FIG. 4E shows another exemplary embodiment. In this case the reflector 25 may be designed to reflect positive angle light from the LED to angles 114A between −45° and −70° with respect to the LED central axis. In one embodiment at least a portion of the light emitted from the LED between +0° and +90° is reflected to angles between −45° and −70° with respect to the LED central axis. In a further embodiment, the reflector may reflect to angles between −45° and −90° with respect to the LED central axis. In one embodiment at least a portion of the light emitted from the LED between +0° and +90° is reflected at angles between −45° and −70° with respect to the LED central axis FIGS. 3A-3E and FIGS. 4A-4E show unique sizes and shapes for the reflector segments. Reflector segments 101 and 111 direct the LED light at high angles without making the reflector too large. This can be accomplished by folding back the LED light. FIG. 5 shows a ray trace for a reflector 60 that also directs light to high angles but that does not fold back the LED light. One can see the advantage of reduced sized that the reflectors 15, 25 of FIGS. 3A-3E and FIGS. 4A-4E have over the reflector shown in FIG. 5.

The reflector segments 101-104 in FIGS. 3A-3E and 111-114 in FIGS. 4A-4E may have smooth transitions or may have abrupt transitions, as shown in FIGS. 3A-3E and 4A-4E. FIGS. 3A-3E and 4A-4E show four segments 101-104 of the reflector 15, although only two or more segments may be needed. In a further embodiment five or more segments may be used. The reflector segments 101-104 of FIGS. 3A-3E and 111-114 of FIGS. 4A-4E may be combined or interchanged to achieve other patterns. Also, the reflectors 15, 25 shown in FIGS. 3A-3E and 4A-4E may be used together.

In many illumination applications it is preferred that all or at least most of the light is directed toward the target area on the ground. Some applications require that almost no light is directed upward to be a "Dark Sky Compliant" product. As can be seen in FIGS. 3A-3E and FIGS. 4A-4E essentially all of the LED light emitted upward (between 0° and −180°) is redirected downward (between 0° and −180°). In one embodiment the reflector redirects at least 75% of the LED luminous flux emitted between 0° and +180° to angles between 0° and −180° with respect to the LED central axis.

Also, an illumination device can be beneficially constructed including plurality of the illumination devices 100 and 200 operating together. As shown in an embodiment in FIG. 1 utilizing two illumination devices $\mathbf{100}_1$ and $\mathbf{100}_2$ from the embodiment of FIGS. 3A-3E, a first illumination source $\mathbf{100}_1$ may be positioned with respect to a second illumination source $\mathbf{100}_2$ so that the LED central axis of the one or more first LEDs of the first illumination source is angled at about 180° from the LED central axis of the one or more second LEDs of the second illumination source. This allows the two illumination sources $\mathbf{100}_1$ and $\mathbf{100}_2$ to be used in a complimentary fashion. In one embodiment, the 180° has a tolerance of +/−20°. The +/−20° tolerance may be with respect to the vertical axis or the horizontal axis. In FIG. 1, the vertical axis runs up and down the page whereas the horizontal axis runs in and out of the page. In this configuration the light that is directed forward and downward from the first LED illumination device $\mathbf{100}_1$ may be complimented by the light that is reflected from the second LED illumination device $\mathbf{100}_2$. In many designs the present inventor has found the use of complimentary LED illumination devices shown here to provide great flexibility and better uniformity or more complex uniform patterns for specialty applications.

Figure 7A:
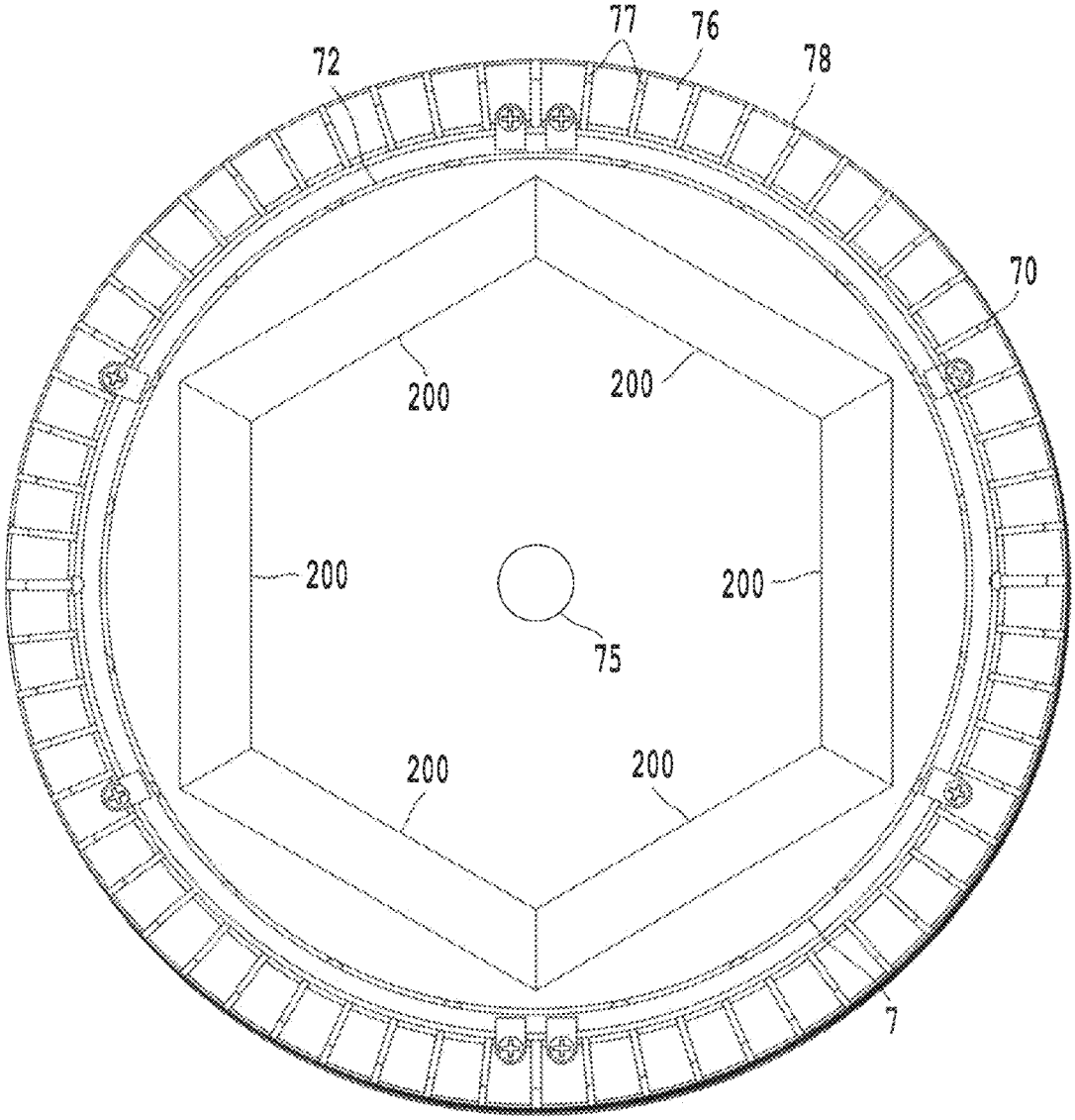
FIGS. 7A and 7B show another embodiment of an illumination device in the present invention.
Figure 7B:
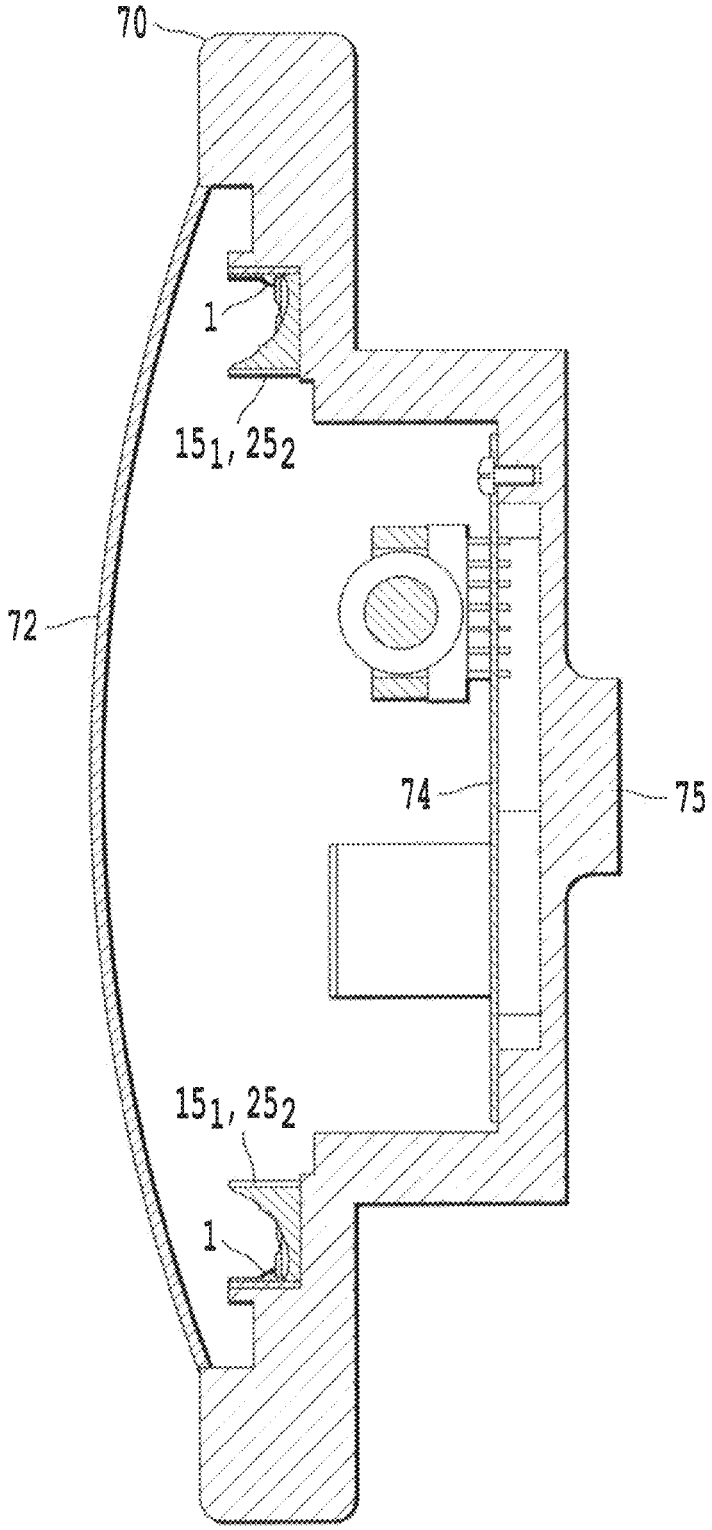

In a further embodiment three or more illumination sources are angled relative to each other and on approximately the same plane so that the LED central axis of each set is angled approximately toward a central point. In an even further embodiment three or more sets are angled relative to each other and on approximately the same plane so that the LED central axis of each set is angled approximately away from a central point. The various illumination sources may be aligned on approximately the same plane. An exemplary embodiment of this is shown in FIGS. 7A and 7B wherein six illumination devices are aligned on approximately the same plane and the LED central axis of each set is angled approximately toward a central point.

Figure 6A:
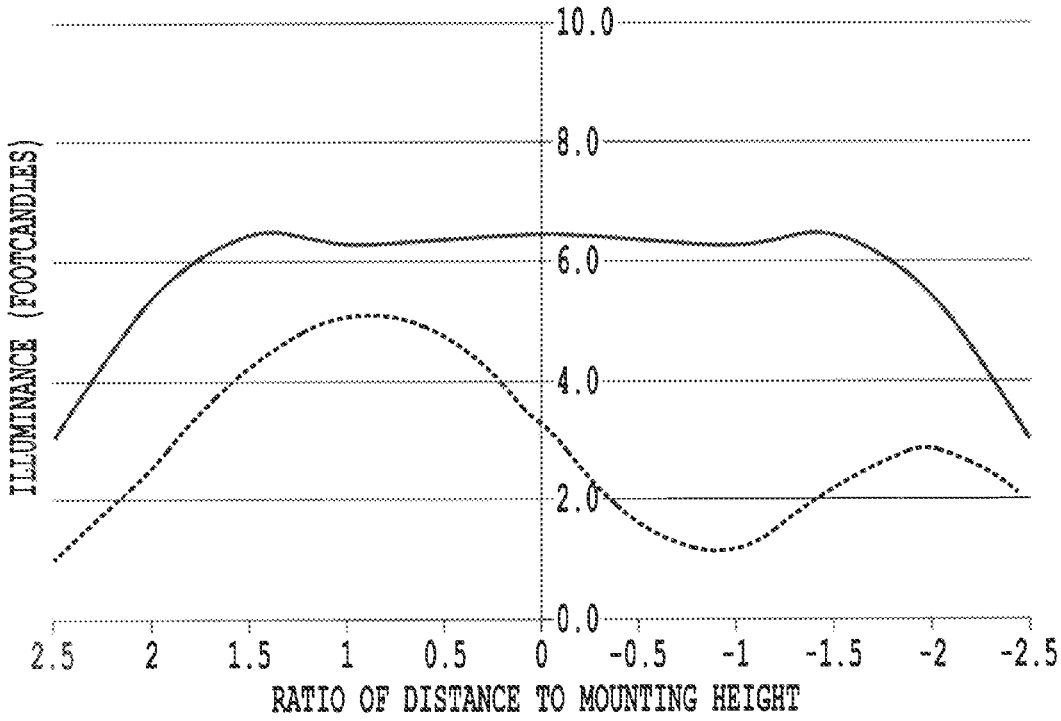
FIGS. 6A and 6B show illuminance patterns realized by different illumination devices of embodiments in the present invention.

FIG. 6A shows an example illuminance pattern generated by the illumination source shown in FIGS. 3A-3E. The dashed line in FIG. 6A shows the illuminance for a single illuminance source. The solid line in FIG. 6A shows the illuminance for two illuminance sources, as shown in FIGS. 3A-3E, positioned at about 180° from each other as shown in FIG. 1. The solid line in FIG. 6A shows the complimentary effect of the two illuminance sources $\mathbf{100}_1$ and $\mathbf{100}_2$ arranged about 180° from each other as in FIG. 1. As can be seen, the use of complimentary LED illumination devices shown here provides excellent uniformity. That is to say that the high and low values are averaged out and a smooth uniform illumination pattern is achieved.

Figure 6B:
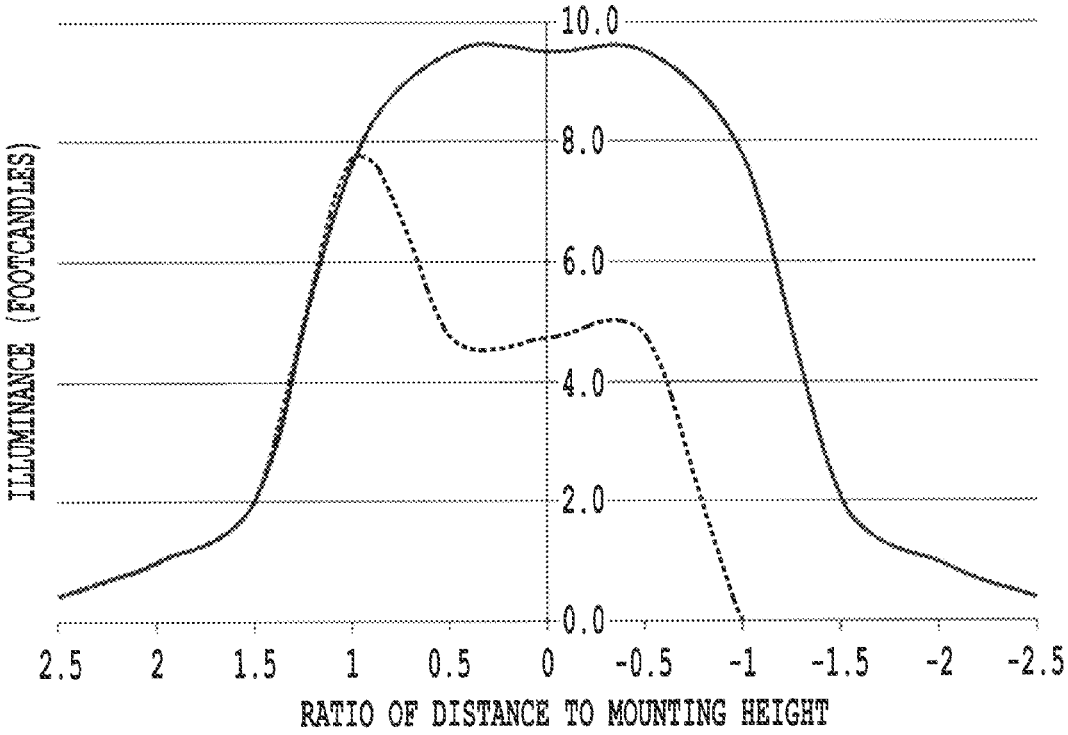

FIG. 6B shows an example illuminance pattern for the illumination source shown in FIGS. 4A-4E. The dashed line in FIG. 6B shows the illuminance of a single illuminance source. The solid line in FIG. 6B shows the illuminance for two illuminance sources, as shown in FIGS. 4A-4E, positioned at about 180° from each other. The solid line in FIG. 6*b* shows the complimentary effect of two illuminance sources arranged about 180°. As can be seen, the use of complimentary LED illumination devices provides excellent uniformity. That is to say that the high and low values area averaged out and a smooth uniform illumination pattern is achieved.

Positioning two LED illumination devices $\mathbf{100}_1$ and $\mathbf{100}_2$ as in FIG. 1 at about 180° apart may provide a long and narrow illumination pattern. In an alternate structure three LED illumination devices 100 can be arranged together at about 120° apart. This may provide a more circularly symmetric illumination pattern. In another alternate structure four or more LED illumination devices 100 can be arranged together at about 90° apart or less. This may provide an even more circularly symmetric illumination pattern. In an exemplary embodiment, six or more LED illumination devices 100 are arranged together at about 60° apart as shown in FIGS. 7A and 7B.

Figure 8:
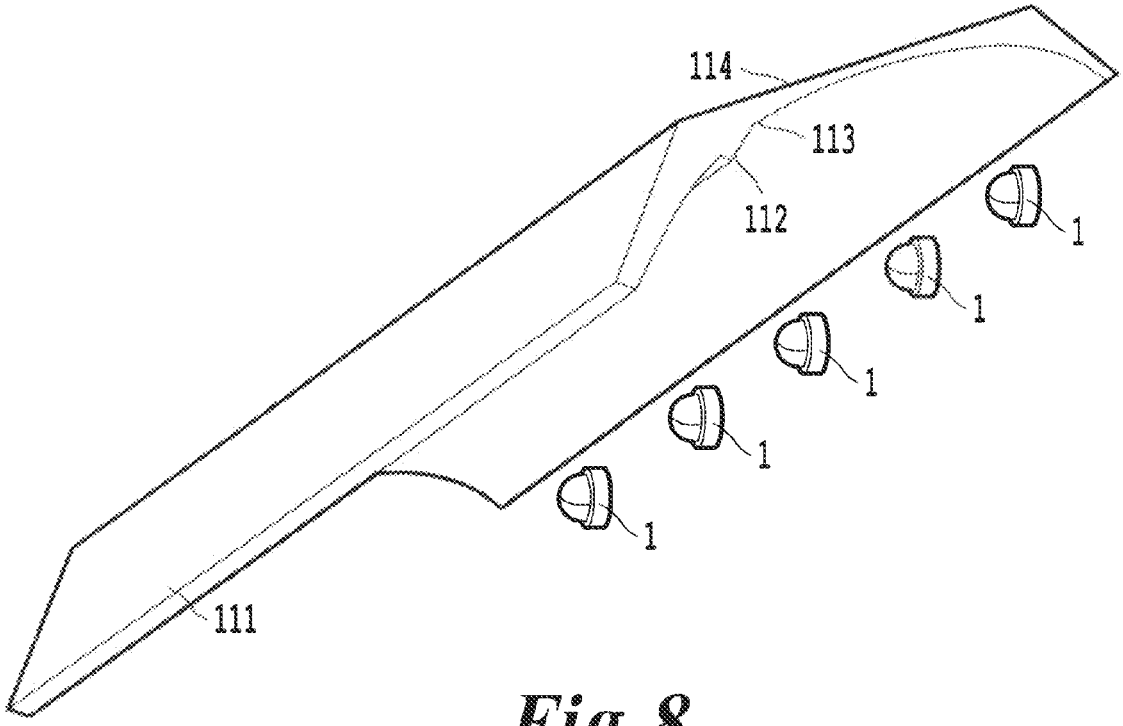
FIG. 8 shows an embodiment of an illumination device of the present invention.

In one embodiment, the reflectors 15, 25 of the LED illumination devices 100, 200 can be a linear or projected reflector. This is shown in FIG. 8 for the reflector cross section of the embodiment of FIGS. 4A-4E. The LEDs 1 may be positioned on a plane in a line or may be staggered about the line. The reflector cross section may be projected along a straight line or along a curved line. In one embodiment the reflector cross section is revolved in a partial or even a full circle in a complete unit or in sections. The reflectors 15, 25 of FIGS.

3A-3E can be revolved in a similar fashion. The LEDs 1 may be placed so that they follow the same or a similar arc to that of the reflector revolution or arc.

The one or more LEDs 1 can include an array of LEDs. The array of LEDs can be positioned along a common plane as shown in FIG. 8 or along a curved surface. In one embodiment the LEDs 1 are positioned on a common circuit board. The circuit board may be flat or it may be curved as may be the case, for example, if a flexible circuit board is used.

In FIGS. 3A-3E and 4A-4E the reflectors 15 and 25 are shaped so that the light emitted directly in front of the LED 1 (light emitted directly along the central optical axis of the LED 1) is redirected away from the central axis of the LED by the reflectors 15, 25. Also, the light emitted from the LED 1 at dominantly positive angles may be reflected by the reflectors 15 and 25 to dominantly negative angles with respect to the LED central axis as shown FIGS. 3A-3E and 4A-4E.

Figure 10A:
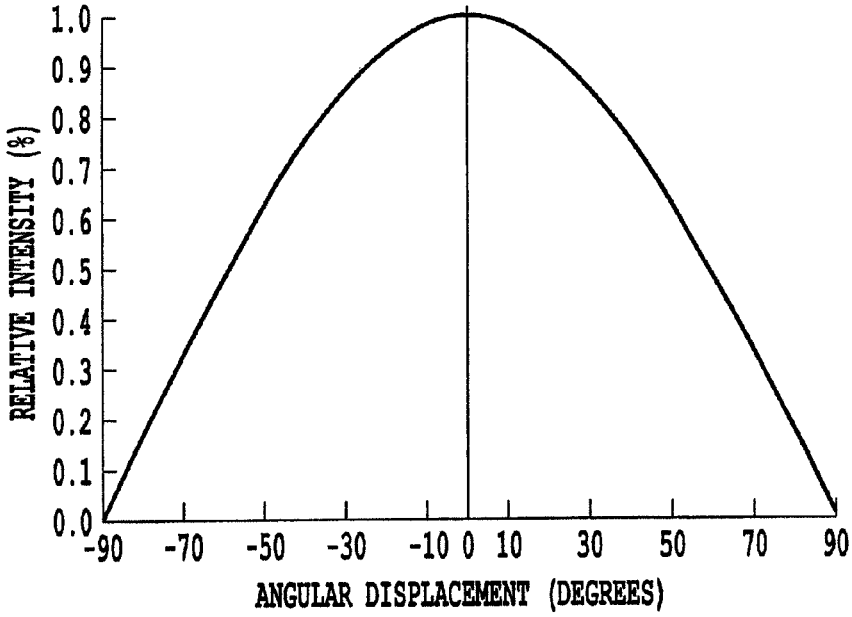
Fig. 10A PRIOR ART
FIG. 10A shows an intensity distribution of a background LED.
Figure 10B:
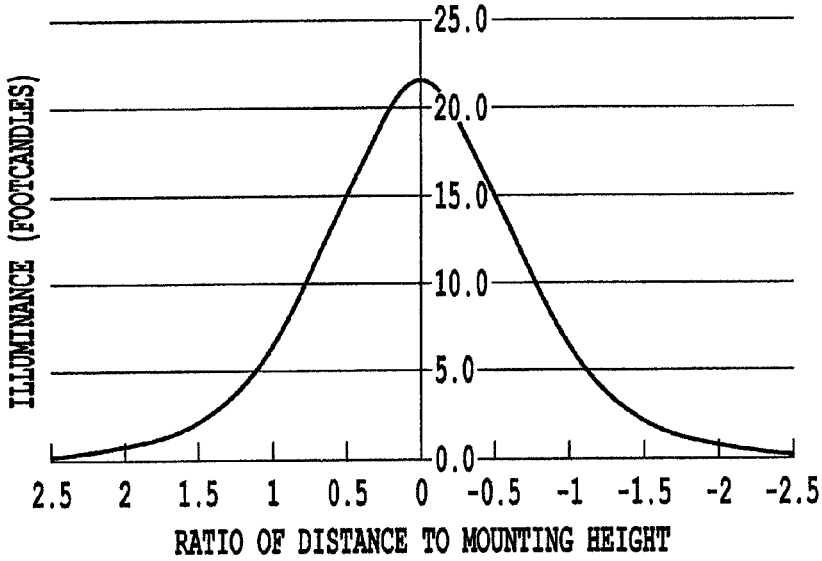
Fig. 10B PRIOR ART
FIG. 10B show an illuminance plot of a background illumination device.

FIG. 10A shows the cosine-like intensity profile of a background example LED and FIG. 10B shows the illuminance profile that results when an example luminaire with conventional LEDs illuminates a surface directly in front of the LED when no optic is used. In this case the example luminaire includes 52 LEDs each emitting 83 lumens. As shown in FIG. 10B, there is a hotspot in the center and the illuminance drops very quickly moving away from the center axis. As mentioned earlier, this is the known $\cos^4 \theta$ effect when the light source approximately follows a cosine distribution as in FIG. 10A. In this example the maximum illuminance is about 21 footcandles and the minimum illuminance is about 0.2 footcandles. The resulting illuminance ratio is over 100 to 1 and would exceed the requirements of most applications.

Figure 11:
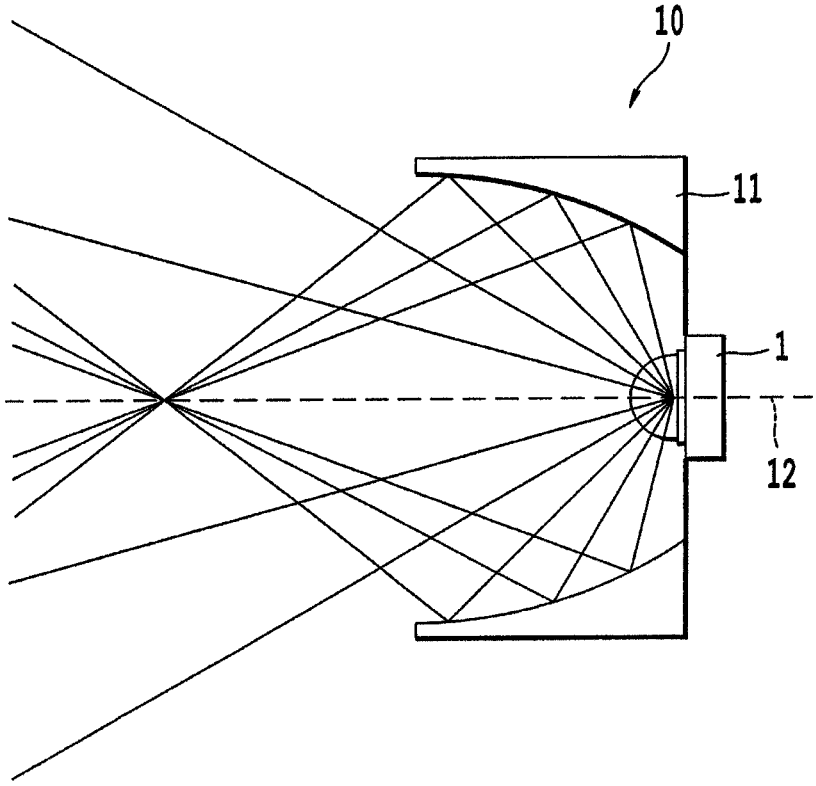
Fig. 11 PRIOR ART
FIG. 11 shows a background art LED illumination device.

As noted above with respect to FIG. 11, a background LED illumination device 10 has the LED 1 and the reflector 11 approximately oriented along a same central axis. The result is the generation of a circular-based illumination/intensity pattern. The reflector 11 can be used to increase the illuminance in various areas of the target surface. However, it is not possible to reduce the illuminance directly in front of the LED using the reflector optic 11 shown in FIG. 11. In the device of FIG. 11 there will always be a hotspot on the illumination surface directly in front of the LED. In that example the illumination does not fall below 21 footcandles. Furthermore, when illuminating an area with a ratio of distance to mounting height as much as 2.5, substantially all of the light within +/−68° is already directed into the target area. FIG. 10A shows there is very little light left beyond 68° that can be redirected into the target area with the reflector. This small amount of light cannot significantly increase the low illuminance regions at the edge of the target area.

In contrast to such a background structure such as in FIG. 11, in the embodiments in FIGS. 1, 3A-3E, and 4A-4E the surface of the reflectors 15, 25 crosses directly in front of the central optical axis of the LED 1. As a result, the highest intensity light is diverted away from the central axis and toward higher angles. The hotspot is eliminated and this high intensity light is directed toward the edge of the target area where higher intensity light is needed due to the cosine effects.

To create the desired light output intensity pattern, the reflectors 15, 25 in the embodiments of FIGS. 1, 3A-3E and 4A-4E can have a conic or conic-like shape. The reflectors 15, 25 can take the shape of any conic including a hyperbole, a parabola, an ellipse, a sphere, or a modified conic.

A specific implementation of any of the embodiments of FIGS. 1, 3A-3E and 4A-4E and 8 is shown in FIGS. 7A and 7B. In that embodiment of FIGS. 7A and 7B six different illumination devices 200 are connected together to form a 360° hexagon. Those six illumination devices 200 connected together are formed inside of a housing 70, which for example can be made of die cast aluminum, and are covered by a lens 72, which for example can be polycarbonate, acrylic, or glass. FIG. 7B shows an example of one of the illumination devices 200 implemented in such a device. As shown in FIG. 7B two LEDs 1 are mounted on the aluminum housing 70 with reflectors $\mathbf{15}_1$, $\mathbf{25}_1$, and $\mathbf{15}_2$, $\mathbf{25}_2$ opposite thereto, as shown in the embodiment of FIG. 1. A power supply and other electronic circuitry needed to drive the illumination device 74 are mounted at a bottom piece portion of the housing 70. As shown for example in the embodiment of FIG. 7B the two illumination devices $\mathbf{100}_1$ and $\mathbf{100}_2$ are spaced apart from each other by approximately 180° again as shown for example in FIG. 1.

The housing may be mounted using a chain or conduit. The housing in FIG. 7A has an opening 75 for a conduit to physically connect to the housing for mounting purposes. The LED central axes may be angled approximately toward a central point and the conduit opening may also have an axis directed toward the central point. In this way the LED central axes and the conduit opening axis may be positioned at about 90° to each other. The housing can have fins 77 oriented around the housing to dissipate LED heat. There may be openings 76 between the fins 77 for air to pass. The fins 77 may have a ring 78 around the outer perimeter to dissipate heat and protect the fins 77 from physical damage. A cover 72, that may be clear, can be used to seal the housing. The LEDs and power supply may be located between the conduit opening and the cover 72. Another ring, not shown, may be used to compress the cover to the housing.

Figure 9:
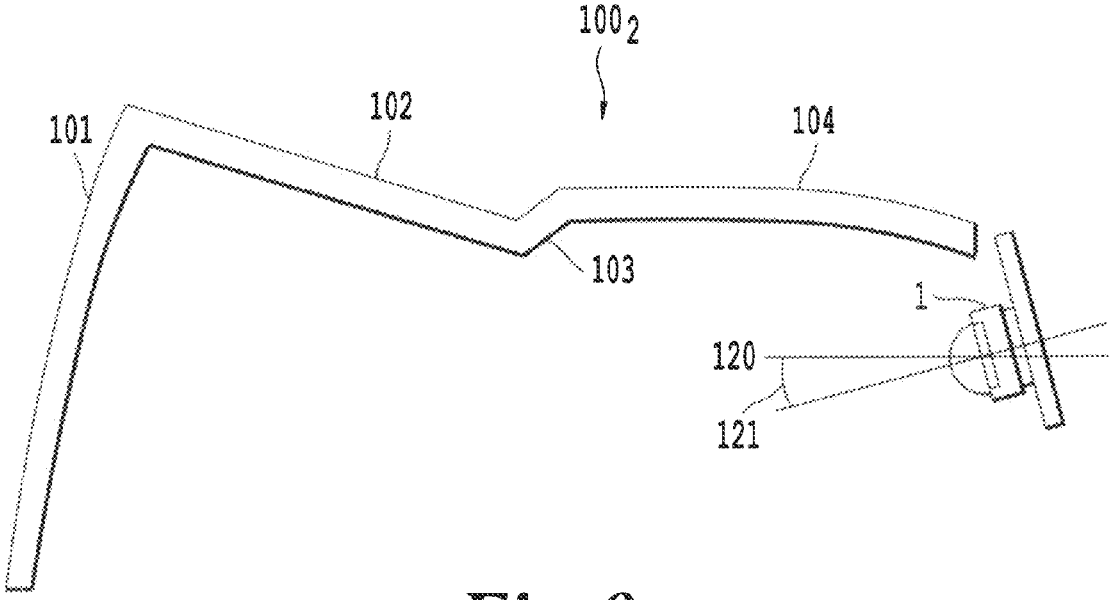
FIG. 9 shows a further embodiment of an illumination device in the present invention.

In some cases it may be necessary to add draft angles inside the housing for ease of manufacturing such as casting and production assembly. In this case it may be necessary to position the one or more LEDs 1 at an angle 121 as shown in FIG. 9 with respect to a primary central axis 120. FIG. 9 shows the LEDs 1 at about a 15° angle but the LED central axis but may by rotated by 30° or even 45° with respect to a primary central axis 120. This simply rotates the angle of the LED central axis but would not change the resulting output angles of the light fixture, although the reflector shapes may change to some extent. The LED central axis herein is referenced to the peak intensity of the LED. The peak intensity is shown at 0° in FIG. 10*a* for an example LED.

Choosing the specific cross section shape of any of the reflectors 15, 25 can change the illumination/intensity pattern generated by the LED illumination device. As noted above, the reflectors 15, 25 can each have a conic or conic-like shape to realize a semicircle-based illumination/intensity pattern.

Conic shapes are used commonly in reflectors and are defined by the function:

$$z = \frac{cr^2}{1 + \sqrt{1 - (1 + k)c^2r^2}} \qquad (1)$$

$$r^2 = x^2 + y^2$$

where x, y, and z are positions on a typical 3-axis system, k is the conic constant, and c is the curvature. Hyperbolas ($k<-1$), parabolas ($k=-1$), ellipses ($-1<k<0$), spheres ($k=0$), and oblate spheres ($k>0$) are all forms of conics. The reflectors 11, 21 shown in FIGS. 2 and 9 were created using $k=-0.55$ and $c=0.105$. FIGS. 3A-3E and 4A-4E shows the reflectors 100 and 200 used in the present embodiments of the present invention. Changing k and c will change the shape of the illumination/intensity pattern. The pattern may thereby sharpen or blur, or may also form more of a donut or 'U' shape, as desired.

One can also modify the basic conic shape by using additional mathematical terms. An example is the following polynomial:

$$z = \frac{cr^2}{1 + \sqrt{1 - (1 + k)c^2r^2}} + F \tag{2}$$

where F is an arbitrary function, and in the case of an asphere F can equal $$\sum_{n=2}^{10} C_{2n} r^{2n}, \tag{3}$$

in which C is a constant.

Conic shapes can also be reproduced/modified using a set of points and a basic curve such as spline fit, which results in a conic-like shape for the reflectors 15.

In one embodiment, F(y) is not equal to zero, and equation (1) provides a cross-sectional shape which is modified relative to a conic shape by an additional mathematical term or terms. For example, F(y) can be chosen to modify a conic shape to alter the reflected light intensity distribution in some desirable manner. Also, in one embodiment, F(y) can be used to provide a cross-sectional shape which approximates other shapes, or accommodates a tolerance factor in regards to a conic shape. For example, F(y) may be set to provide cross-sectional shape having a predetermined tolerance relative to a conic cross-section. In one embodiment, F(y) is set to provide values of z which are within 10% of the values provided by the same equation but with F(y) equal to zero.

Thereby, one of ordinary skill in the art will recognize that the desired illumination/intensity pattern output by the illumination devices 90 can be realized by modifications to the shape of the reflectors 15 by modifying the above-noted parameters such as in equations (1), (2).

Obviously, numerous additional modifications and variations of the present invention are possible in light of the above teachings. It is therefore to be understood that within the scope of the appended claims, the present invention may be practiced otherwise than as specifically described herein.

The invention claimed is:

1. An illumination source comprising:

a light emitting diode (LED) light source, wherein an LED central axis is at 0°; and a reflector, wherein the reflector comprises at least four contiguous segments;

wherein at least a portion of light emitted between 0° and +60° from the LED light source is reflected by a first segment of the at least four contiguous segments of the reflector to angles between −30° and −50°;

wherein at least a portion of the light emitted between −10° and +10° from the LED light source is reflected by a last segment of the at least four contiguous segments of the reflector to angles between −130° and −160°, wherein the last segment crosses directly in front of the central axis of the LED;

wherein at least a portion of the light emitted between −20° and −70° from the LED light source is not reflected by the reflector.

2. The illumination source according to claim 1, wherein at least a portion of the light emitted between 0° and +90° from the LED light source is reflected by the reflector at an angle of approximately −90°.

3. The illumination source according to claim 1, wherein the LED light source includes two illumination sources positioned at about 180° apart.

4. The illumination source according to claim 1, wherein the LED light source includes three or more illumination sources positioned at about 120° or less apart.

5. The illumination source according to claim 1, wherein the LED light source comprises an array of light emitting diodes positioned along a common plane.

6. The illumination source according to claim 1, wherein at least a portion of the reflector has a conic or conic-like shape.

7. The illumination source according to claim 6, wherein the conic or conic-like shape of the reflector has a shape selected from the group consisting of: a hyperbola; a parabola; an ellipse; a sphere; or a modified conic.

8. The illumination source according to claim 1, wherein reflecting surfaces of the reflector are revolved in a circle.

9. The illumination source according to claim 1, wherein reflecting surfaces of the reflector are extruded or projected linearly.

10. The illumination source according to claim 9, wherein the reflecting surfaces are projected along a conic or conic-like curve.

11. An illumination source comprising:

a light emitting diode (LED) light source, wherein an LED central axis is at 0°;

a reflector, wherein the reflector comprises at least four contiguous segments;

wherein at least a portion of light emitted between 0° and +90° from the LED light source is reflected by a first segment of the at least four contiguous segments of the reflector to angles between −45° and −70°, wherein the first segment crosses directly in front of the central axis of the LED;

wherein at least a portion of the light emitted between −10° and −40° from the LED light source is reflected by a last segment of the at least four contiguous segments of the reflector to angles between −100° and −130°;

wherein at least a portion of the light emitted between −20° and −70° from the LED light source is not reflected by the reflector.

12. The illumination source according to claim 11, wherein at least a portion of the light emitted between 0° and +90° from the LED light source is reflected by the reflector at an angle of approximately −90°.

13. The illumination source according to claim 11, wherein the LED light source includes two illumination sources positioned at about 180° apart.

* * * * *